United States Patent [19]

Lum

[11] Patent Number: 4,833,124

[45] Date of Patent: May 23, 1989

[54] PROCESS FOR INCREASING THE DENSITY OF IMAGES OBTAINED BY THERMAL DYE TRANSFER

[75] Inventor: Kin K. Lum, Webster, N.Y.

[73] Assignee: Eastman Kodak Company, Rochester, N.Y.

[21] Appl. No.: 129,038

[22] Filed: Dec. 4, 1987

[51] Int. Cl.[4] ..... B41M 5/035; B41M 5/26

[52] U.S. Cl. ..... 503/227; 8/471; 427/265; 428/195; 428/913; 428/914

[58] Field of Search ..... 8/470, 471; 427/265; 428/195, 201, 203, 204, 207, 480, 913, 914; 430/200, 201, 945; 503/227

[56] References Cited

U.S. PATENT DOCUMENTS 4,700,207 10/1987 Vanier et al. ..... 503/227

*Primary Examiner*—Bruce H. Hess

*Attorney, Agent, or Firm*—Harold E. Cole

[57] ABSTRACT

A process for increasing the density of a thermal dye transfer image comprising image-wise-heating a dye-donor element comprising a support having thereon a dye layer and transferring a dye image to a dye-receiving element to form an image having a certain density, and image-wise-heating at least one more time another portion of the dye-donor element or another dye-donor element and transferring a second dye image, which is of the same hue as the first dye image and is in register with the first dye image, to the dye-receiving element to increase the density of the transferred image.

10 Claims, No Drawings

PROCESS FOR INCREASING THE DENSITY OF IMAGES OBTAINED BY THERMAL DYE TRANSFER

This invention relates to a process for increasing the density of images obtained by a thermal dye transfer process, which is especially useful for transparencies.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original pictured viewed on a screen. Further details of this process and an apparatus for carryig it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

The process described above can be used to obtain reflection prints which have a transferred reflection density of about 1.6–2.0. In some circumstances, however, it may be desirable to transfer a "security" dye, such as an infrared dye, which may not transfer easily, resulting in insufficient density. In other applications, such as transparencies, much higher transmission densities on the order of at least about 2.5 must be obtained.

One of the ways to increase the density of a transferred image is to merely increase the amount of dye in the dye-donor element and also to increase the amount of power used to transfer the dye. However, this is costly in terms of material and power requirements. In addition, it is harder to coat higher amounts of dye in the dye-binder layer and increasing the power to the thermal head (duration and time) creates problems of receiver deformation.

Another way to increase the density of a transferred image would be to lower the amount of binder in the dye-donor element, thereby lowering the path length for dye diffusion and increasing the dye transfer efficiency. There is a problem in doing that, however, since a higher amount of dye in the dye layer generally creates a tendency for the dye to crystallize on keeping. In addition, there would also be a higher amount of sticking of the donor to the receiver during the printing operation.

Other ways to increase the density of the transferred image is to either find new dyes which have higher thermal dye efficiency or find materials which could be added to the dye later to increase the transfer efficiency. This would mean, however, in the case of reflection prints and transparencies, that different dye-donor elements would be required, resulting in increased manufacturing costs and inconvenience to the user.

It would be desirable to provide a way to increase the density of transferred images in thermal dye transfer processes. It would also be desirable to find a way to use the same dye-donor element for a reflection print as for a transparency, without increasing the power requirements to obtain the transparency.

These and other objects are achieved in accordance with this invention which comprises a process for increasing the density of a thermal dye transfer image comprising imagewise-heating a dye-donor element comprising a support having thereon a dye layer and transferring a dye image to a dye-receiving element to form an image having a certain density, and imagewise-heating at least one more time another portion of the dye-donor element or another dye-donor element and transferring a second dye image, which is of the same hue as the first dye image and is in register with the first dye image, to the dye-receiving element to increase the density of the transferred image.

The above process can be repeated two or more times in order to increase the density to the desired level. Thus, in a preferred embodiment of the invention, another dye-donor is imagewise heated and a third dye image, the same as the other two images of the same dye, is transferred in register to the dye-receiving element to form an image having even more density.

The dye image-receiving layer of the dye-receiver employed in the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and glycol or a divalent phenol. Examples of such glycols or divalent phenols are p-xylylene glycol, 2,2-bis(4-oxyphenyl)propane, bis(4-oxyphenyl)methane, 1,1-bis(4-oxyphenyl)ethane, 1,1-bis(oxyphenyl)-butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula

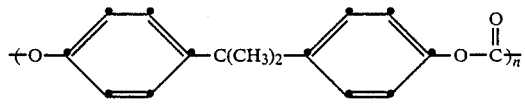

wherein n is from about 100 to about 500.

Examples of such polycarbonates include General Electric Lexan®, Polycarbonate Resin #ML-4735 (Number average molecular weight app. 36,000), and Bayer AG Makrolon #5705® (Number average molecular weight app. 58,000). The later material has a $T_g$ of 150° C.

The support for the dye-receiving element employed in the invention may be a transparent film when transparencies are desired to be obtained such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, poly(ethylene terephthalate) is employed.

A dye-donor element that is used with the dye-receiving element employed in the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co., Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

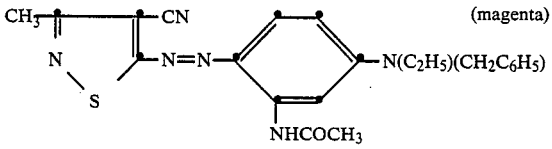

(magenta)

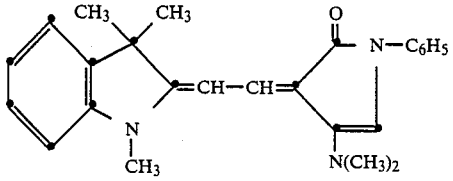

(yellow)

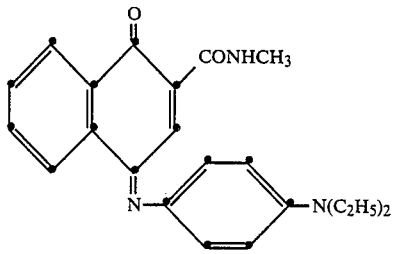

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A black-and-white or neutral-hue dye image could also be obtained using the invention by employing mixtures of cyan, magenta and yellow dyes, using a neutral-hue dye, or by using the process described above repeatedly for each color without differentiating the color record being printed.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities. Such dye-barrier layer materials include those described and claimed in U.S. Pat. 4,700,208 of Vanier et al. issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly-(ethylene terephthalate) support coated with sequential repeating areas of cyan, magenta and yellow dye, and the above process steps are sequentially performed for each color at least two times to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

In another embodiment of the invention, lasers could be used to transfer dye from the donor to the receiver. This could be accomplished by incorporating an infrared absorbing dye in the dye donor element.

The following example is provided to illustrate the invention.

EXAMPLE

Dye receivers were prepared by coating the following layers in the order recited on a 100 μm thick transparent poly(ethylene terephthalate) film support:

(a) Subbing layer of poly(acrylonitrile-co-vinylidene chloride-co-acrylic acid) (14:80:6 wt ratio) (0.059 g/m$^2$) coated from 2-butanone;

(b) Polymeric intermediate layer of poly(butylacrylate-co-acrylic acid) (50:50 wt. ratio)(8.1 g/m$^2$);

(c) Polymeric intermediate layer of FC-430 ® surfactant (3M Company) (0.0046 g/m$^2$) and the following partially sulfonated glycol-phthalate (0.44 g/m$^2$):

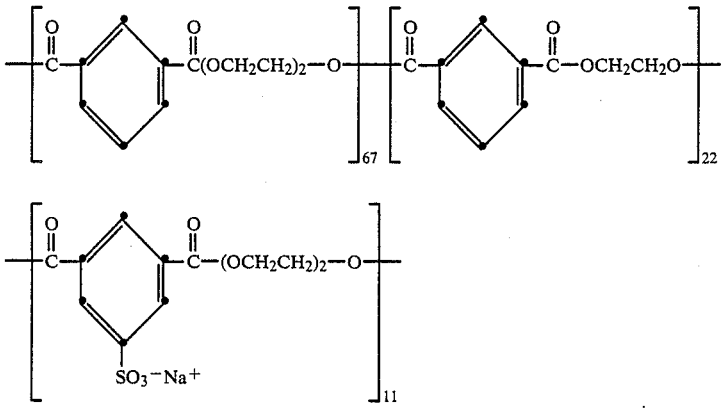

(d) Dye-receiving layer of Makrolon 5705 ® polycarbonate (Bayer AG) (2.9 g/m$^2$), 1,4-didecoxy-2,5-dimethoxybenzene (0.38 g/m$^2$), Tone-300 ® polycaptolactone (Union Carbide Corp.) (0.38 g/m$^2$), and FC-431 ® surfactant (3M Corp.) (0.01 g/m$^2$) coated from a dichloromethane and trichloroethylene solvent mixture; and (e) Overcoat layer of Tone-300 ® polycaptolactone (Union Carbide Corp.) (0.11 g/m$^2$) and 3M Corp. FC-431 ® surfactant (0.005 g/m$^2$) coated from a dichloromethane and tricholoroethylene solvent mixture.

A cyan, magenta and yellow dye-donor element was prepared as follows. On one side of a 6 μm poly(ethylene terephthalate) support, a subbing layer of titanium n-butoxide (duPont Tyzor TBT ®) (0.081 g/m$^2$) was Gravure-printed from a n-propyl acetate and 1-butanol solvent mixture. On top of this layer were Gravure-printed repeating color patches of cyan, magenta and yellow dyes. The cyan coating contained the cyan dye illustrated above (0.28 g/m$^2$) and cellulose acetate propionate (2.5% acetyl, 45% propionyl) binder (0.44 g/m$^2$) from a toluene, methanol and cyclopentanone solvent mixture. The magenta coating contained the magenta dye illustrated above (0.15 g/m$^2$) in the same binder as the cyan dye (0.32 g/m$^2$). The yellow coating contained the yellow dye illustrated above (0.14 g/m$^2$) in the same binder as the cyan dye (0.25 g/m$^2$).

On the reverse side of the dye-donor was coated a subbing layer of Bostik 7650 ® polyester (Emhart Corp.) (43. mg/m$^2$) coated from a toluene and 3-pentanone solvent mixture and a slipping layer of PS-513 ® amino-terminated silicone (Polymer Sciences) (0.013 g/m$^2$) and p-toluenesulfonic acid (0.043 g/m$^2$) in a cellulose acetate propionate (2.5% acetyl, 45% propionyl) binder (0.40 g/m$^2$) from a toluene, methanol and 3-pentanone solvent mixture.

The dye-side of the dye-donor element strip 4 inches (10. cm) wide was placed in contact with the dye image-receiving layer of a dye-receiver element strip of the same width. The assemblage was fastened in a clamp on a rubber-roller of 2.23 in (56.7 mm) diameter driven by a stepper motor. A TDK 6-2Q23-2 Thermal Head was pressed at a force of 8 pounds (3.6 kg) against the dye-donor element side of the assemblage pushing it against the rubber roller.

The imaging electronics were activated causing the device ot draw the assemblage between the printing head and roller at 0.28 inches/sec (7 mm/sec). Coincidentally the resistive elements in the thermal print were heated using a supplied voltage of approximately 24v, representing approximately 1.2 watts/pixel (28 mjoules/pixel group).

Eleven-step graduated density test images were generated on each dye-receiver using the individual yellow, magenta, or cyan dye-donors. Each imaged area on the dye-receiver was then "over-printed" in register using an unused area of the dye-donor of the same hue as used for the original printing. Images with a single 1X-printing, 2X-printing (one over-printing), and 3X-printing (two over-printings) were produced on separate receivers and the transferred Status A blue, green or red transmission densities were obtained. Neutral images were also obtained by printing in sequence a superposed-tricolor stepped image from the yellow, magenta, and cyan dye-donors and then overprinting in sequence from the three dye donors to provide 1X, 2X, and 3X printings. Status A densities of these neutral images were also obtained. The following results were obtained:

TABLE

| | Single Color Transfer | | | | | | | | |
|---|---|---|---|---|---|---|---|---|---|
| | Yellow Dye Blue Density | | | Magenta Dye Green Density | | | Cyan Dye Red Density | | |
| Step | 1X | 2X | 3X | 1X | 2X | 3X | 1X | 2X | 3X |
| 1 | 0.03 | 0.03 | 0.03 | 0.02 | 0.02 | 0.02 | 0.02 | 0.02 | 0.02 |
| 5 | 0.09 | 0.12 | 0.14 | 0.08 | 0.12 | 0.15 | 0.07 | 0.10 | 0.13 |
| 8 | 0.49 | 0.82 | 1.11 | 0.40 | 0.66 | 0.93 | 0.43 | 0.74 | 1.09 |
| 9 | 0.77 | 1.31 | 1.78 | 0.63 | 1.08 | 1.51 | 0.69 | 1.22 | 1.74 |
| 10 | 1.15 | 1.90 | 2.64 | 0.96 | 1.64 | 2.33 | 1.03 | 1.79 | 2.52 |
| 11 | 1.61 | 2.65 | 3.52 | 1.40 | 2.44 | 3.36 | 1.37 | 2.45 | 3.25 |
| | Neutral Hue Transfer (Cyan + Magenta + Yellow Dye) | | | | | | | | |
| | Blue Density | | | Green Density | | | Red Density | | |
| Step | 1X | 2X | 3X | 1X | 2X | 3X | 1X | 2X | 3X |
| 1 | 0.03 | 0.03 | 0.03 | 0.02 | 0.02 | 0.02 | 0.02 | 0.02 | 0.02 |
| 5 | 0.10 | 0.14 | 0.19 | 0.09 | 0.11 | 0.14 | 0.07 | 0.09 | 0.11 |
| 8 | 0.67 | 1.14 | 1.58 | 0.55 | 0.93 | 1.27 | 0.50 | 0.83 | 1.10 |
| 9 | 1.05 | 1.84 | 2.22 | 0.90 | 1.57 | 2.15 | 0.84 | 1.42 | 1.85 |
| 10 | 1.44 | 2.52 | 3.37 | 1.31 | 2.27 | 3.05 | 1.21 | 2.02 | 2.59 |
| 11 | 1.80 | 3.01 | 4.03 | 1.67 | 2.90 | 3.84 | 1.54 | 2.57 | 3.25 |

The above results show that multiple printings significantly increase the transmission densities at the higher steps without affecting the minimum density.

The invention has been described in detail with particular reference to preferred embodiments thereof, but it will be understood that variations and modifications can be effected within the spirit and scope of the invention.

What is claimed is:

1. A process for increasing the density of a thermal dye transfer image comprising imagewise-heating a dye-donor element comprising a support having thereon a dye layer and transferring a dye image to a dye-receiving element comprising a transparent support having thereon a dye image-receiving layer to form an image having a certain density, and imagewise-heating at least one more time another portion of said dye-donor element or another dye-donor element and transferring a second dye image, which is of the same hue as said first dye image and is in register with said first dye image, to said dye-receiving element to increase the density of said transferred image.

2. The process of claim 1 wherein another dye-donor is imagewise heated and a third dye image, the same as the other two images of the same dye, is transferred in register to said dye-receiving element to form said image having even more density.

3. The process of claim 1 wherein said imagewise heating is done with a thermal print head.

4. The process of claim 1 wherein said imagewise heating is done with a laser.

5. The process of claim 1 wherein said support is poly(ethylene terephthalate).

6. The process of claim 1 wherein said support for the dye-donor element is coated with sequential repeating areas of cyan, magenta and yellow dye, and said process steps are sequentially performed for each color at least two times to obtain a three-color dye transfer image.

7. The process of claim 1 wherein said support for the dye-donor element is coated with sequential repeating areas of cyan, magenta and yellow dye, and said process steps are sequentially performed without differentiation of the color record in order to obtain a neutral-hue dye transfer image.

8. The process of claim 1 wherein said support for the dye-donor element is coated with sequential repeating areas of a neutral-hue dye, and said process steps are sequentially performed to obtain a neutral-hue dye transfer image.

9. The process of claim 1 wherein said dye image-receiving layer is a bisphenol-A polycarbonate having a number average molecular weight of at least about 25,000.

10. The process of claim 9 wherein said bisphenol-A polycarbonate comprises recurring units having the formula

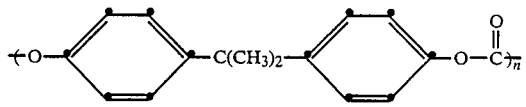

wherein n is from about 100 to about 500.

* * * * *